US005466387A

United States Patent [19]

Pianta et al.

[11] Patent Number: 5,466,387

[45] Date of Patent: Nov. 14, 1995

[54] OIL-SOLUBLE ADDUCTS OF DISUCCINIMIDES AND ANHYDRIDES OF UNSATURATED BICARBOXYLIC ALIPHATIC ACIDS

[75] Inventors: Orazio Pianta, Santo Stefano Ticino; Paolo Koch, Melegnano, both of Italy

[73] Assignee: Agip Petroli S.p.A., Rome, Italy

[21] Appl. No.: 253,054

[22] Filed: Jun. 2, 1994

[30] Foreign Application Priority Data

Jun. 16, 1993 [IT] Italy ..... MI93A1293

[51] Int. Cl.[6] ..... C10M 133/56

[52] U.S. Cl. ..... 252/51.5 A

[58] Field of Search ..... 252/51.5 A; 44/348; C10M 133, 156

[56] References Cited

U.S. PATENT DOCUMENTS 4,686,054 8/1987 Wisotsky et al. ..... 252/32.7 E 4,940,552 7/1990 Cengel et al. ..... 252/51.5 A

FOREIGN PATENT DOCUMENTS

| | | |
|---|---|---|
| 072645 | 2/1983 | European Pat. Off. . |
| 438849 | 7/1991 | European Pat. Off. . |
| 438848 | 7/1991 | European Pat. Off. . |
| 438847 | 7/1991 | European Pat. Off. . |
| 444830 | 9/1991 | European Pat. Off. . |
| 0451397 | 10/1991 | European Pat. Off. . |
| 0451380 | 10/1991 | European Pat. Off. . |
| 219792 | 3/1985 | German Dem. Rep. . |

*Primary Examiner*—Stephen Kalafut
*Assistant Examiner*—Cephia Toomer
*Attorney, Agent, or Firm*—Oblon, Spivak, McClelland, Maier & Neustadt

[57] ABSTRACT

Oil-soluble additives with dispersant properties inert towards fluoroelastomers are described, prepared by reacting an alkyl or alkenyl disuccinimide with an anhydride of an unsaturated bicarboxylic aliphatic acid or the corresponding acid. The reaction is conducted at a temperature of between 130° and 170° C. The molar ratio of anhydride to disuccinimide is between 1.05 and 1.95

8 Claims, No Drawings

OIL-SOLUBLE ADDUCTS OF DISUCCINIMIDES AND ANHYDRIDES OF UNSATURATED BICARBOXYLIC ALIPHATIC ACIDS

This invention relates to a process able to render disuccinimides of dispersant action contained in lubricating oils compatible with the fluorinated elastomer gaskets used in internal combustion engines and industrial machines.

Fluorinated elastomers are commonly used as gaskets in internal combustion engines, in particular to prevent lubricant leakage at those points where moving parts, such as the crankshaft, are in contact with the engine.

In this respect, fluorinated elastomers possess a virtually unique combination of excellent thermal stability and resistance to various types of fluid. Such fluorinated gaskets can however be attacked, under engine operating conditions, by nitrogenated components contained in lubricating oils, in particular by amines of basic character.

In this respect it seems certain that said attack consists of the base-catalyzed elimination of hydrofluoric acid, with the consequent formation of unsaturations. With regard to its mechanical properties, the thus deteriorated fluoroelastomer loses elasticity and elongation, until it no longer possesses sealing capacity.

Of the nitrogenated components normally used in lubricants, disuccinimides with dispersant action have proved particularly critical towards fluorinated elastomers, either when used alone or in combination with viscosity index improvement polymers of dispersant action containing nitrogenated monomers. In this respect, both these classes of additive contain strongly basic amino groups (primary and/or secondary and/or tertiary).

The patent literature describes various processes which can be used to overcome the aforesaid drawback.

For example, U.S. Pat. No. 3,422,017 describes products of the reaction between primary, secondary or tertiary amines and fluorophosphoric acid.

U.S. Pat. No. 4,379,064 teaches mild oxidation of nitrogenated dispersants to make the dispersant unreactive towards fluoroelastomers.

U.S. Pat. No. 4,615,826 describes an oil-soluble adduct prepared by reacting a succinimide having at least one basic nitrogen with fluorophosphoric acid or its ammonium salt.

U.S. Pat. No. 5,080,815 describes dispersants compatible with fluoroelastomers prepared by reacting alkyl anhydrides (or relative bicarboxylic acids), the alkyl group having from 20 to 250 carbon atoms, with aminoguanidine (or relative salts). EP-A-0 136 185 describes a dispersant modified with boron.

All these process, and the relative products, have various drawbacks.

In this respect, U.S. Pat. No. 3,422,017 and U.S. Pat. No. 4,615,826 use a reagent, namely fluorophosphoric acid, which gives rise to ash and can also decompose into toxic products such as hydrofluoric acid. The product described in EP 0 136 185 has the same drawback, ie the formation of ash.

The process described in U.S. Pat. No. 4,379,064 results in an excessive decrease (50–901) in the initial TBN (total basic number).

The solution proposed by U.S. Pat. No. 5,080,815 has the drawback of not using the usual commercially available dispersants, ie alkyl succinimides deriving from the condensation of alkylated succinic anhydride with amines or polyamines.

In all cases the treatments proposed by the known art result in a basicity reduction of the nitrogenated additives by the effect of the reaction between the agent used, generally of acid nature, and the amino group of the additive. This can result in a loss of dispersant properties of the thus modified additives and a consequent failure of the engine tests by which lubricants containing said additives are evaluated.

EP-A-072,645 describes a process for preparing nitrogenated dispersants, consisting of reacting an alkenyl succinic anhydride with a polyamine in two stages, the overall molar ratio of anhydride to polyamine being between 2.3 and 3.0.

It has now been found that nitrogenated dispersants of disuccinimide type can be made compatible with fluoroelastomers by a simple treatment.

It has also been found that this treatment does not detract from the dispersant performance of the lubricant.

The usual viscosity index improver additives with dispersant action (particularly those based on polymethacrylates containing nitrogenated monomers) present in lubricating oil formulations are usually incompatible with fluorinated elastomers. Specific treatment is sometimes required to render them compatible.

It has now been found that if dispersants of succinimide type modified by the process of the present invention are used in lubricants, viscosity index improvement additives of polymethacrylate type containing nitrogenated monomers become compatible with fluoroelastomers.

In accordance therewith the present invention firstly provides an oil-soluble additive with dispersant properties inert towards fluoroelastomers, characterised by being prepared by reacting:

a) at least one alkyl or alkenyl disuccinimide having at least one basic nitrogen, with b) at least one anhydride of an unsaturated bicarboxylic aliphatic acid or the corresponding acid, at a temperature of between 130° and 170° C., preferably between 140° and 160° C., the molar ratio of anhydride to disuccinimide being between 1.05 and 1.95, preferably between 1.2 and 1.6.

The term "basic nitrogen" means any nitrogen atom of amino type.

The term "disuccinimide" means succinimides prepared by reacting an alkyl (or alkenyl) succinic anhydride (or the relative bicarboxylic acid) with a polyamine in a molar ratio of between 2.0 and 2.5. The alkyl or alkenyl radicals of the two anhydrides can be the same or different.

Disuccinimides useful as dispersant additives and their preparation processes are described in U.S. Pat. No. 4,173,540, U.S. Pat. No. 3,401,118 and U.S. Pat. No. 5,021,174.

The term "disuccinimide" also includes by-products present in the disuccinimides, such as amides, imides and amidines. The predominant product is however a disuccinimide, ie the product of reacting the alkenyl (or alkyl) succinic anhydride (or the corresponding acid) with a polyamine.

To prepare dispersants of disuccinimide type the preferred nitrogenated compounds are polyamines, particularly alkylenepolyamines (and relative mixtures) of general formula (I):

$$H_2N—(—R—NH—)_n—H \quad (I)$$

where n is a whole number from 1 to 10, preferably from 2 to 8; R is a divalent hydrocarbon radical with 1–6 and preferably 2–4 carbon atoms.

Said alkylenepolyamines include methylenepolyamines, ethylenepolyamines, propylenepolyamines, butylenepolyamines etc. They also include substituted aminoalkyl piperazines.

For reasons of cost and effectiveness the most convenient polyamines are ethylenepolyamines. These diamines are described in detail in Kirk-Othmer "Encyclopedia of Chemical Technology", Second Edition, Vol. 7, pp 22–39.

The aforesaid disuccinimides are prepared by reacting polyamines of general formula (I) with the alkylated (or alkenylated) succinic anhydride or the corresponding bicarboxylic acid.

It is known that alkyl or alkenyl succinic anhydrides are prepared by reacting maleic anhydride with an unsaturated hydrocarbon of the desired molecular weight at a temperature, particularly for high-boiling olefins, of between 180° and 230° C.

Typical olefins are those deriving from wax cracking, linear alpha olefins, branched chain alpha olefins and light olefin polymers and copolymers. Polymers include polymers of ethylene, propylene, isobutene, 1-hexene, 1-decene and the like. Copolymers include ethylene-propylene, ethylene-isobutene, propylene-isobutene, ethylene-1-decene and similar copolymers. Terpolymers can also be used.

Of the aforelisted possibilities, alkenyl-substituted butene polymers, particularly isobutene polymers, are the most widely used.

The molecular weight of the alkenyl radical can vary within a wide range. However, to achieve dispersant properties and be oil-soluble, the alkenyl radical should have a molecular weight of at least 500. Although there is no critical upper limit, the preferred molecular weight range is 500–5000 and preferably 900–3000.

The alkenyl succinic anhydride prepared in this manner can be used for the reaction with the polyamine of general formula (I), or can be hydrogenated by normal hydrogenation methods to form the corresponding alkyl succinic anhydride and then reacted with (I).

The disuccinimide is prepared from the alkyl or alkenyl succinic anhydride and polyamine of general formula (I) in a molar ratio of 2.0–2.5 at a temperature of 130°–190° C. in the absence of catalyst. It is preferable to operate by removing the formed water from the reaction environment.

According to the process of the present invention, the alkyl or alkenyl disuccinimides are rendered compatible with the fluoroelastomers by treatment with an anhydride of an unsaturated bicarboxylic acid, or the corresponding bicarboxylic acid, of general formula (II):

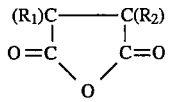

(II)

where $R_1$ and $R_2$ are independently chosen from H and a $C_1$–$C_4$ alkyl or alkenyl radical, there also being a —C=C— double bond.

In a preferred embodiment, $R_1$ and $R_2$ are both H and the double bond is between $CR_1$ and $CR_2$, the compound of general formula (II) therefore being maleic anhydride. In another embodiment $R_1$ represents two —H and $R_2$ is $=CH_2$, the compound of general formula (II) therefore being anhydride of itaconic acid.

The molar ratio of the compound of general formula (II) to the alkyl or alkenyl disuccinimide is between 1.05 and 1.95, and preferably between 1.2 and 1.6.

The reaction between (II) and the disuccinimide is effected between 130° and 170° C., and preferably between 140° and 160° C. It is preferable to feed the disuccinimide into the reactor, heat it to about 100° C., add (II) and then heat the reaction mixture to the reaction temperature.

At the said temperature the reaction is complete in a time of between 1 and 4 hours. At about 160° C. the reaction is virtually complete in two hours.

The reaction does not require catalysts and the final product does not require purification.

The reaction can be conducted without solvents, however it is preferable to use an inert solvent, preferably the same mineral base as that subsequently used in formulating the lubricating oil. Lubricant bases having a viscosity (ASTM D-445) of 2–40, and preferably 5–20, centistokes at $_{100}$° C. can be used for this purpose. The lubricant base known as Solvent 150 Neutral is preferred.

The lubricating oil compositions are formulated with conventional quantities of other additives with different functions, such as viscosity index improvers, anti-rust agents, detergents, antioxidants and anti-wear agents.

A new and very severe procedure was devised to evaluate the compatibility of lubricating oils with fluorinated elastomers. This test, known as VW PV-3344 comprises immersing the fluoroelastomer in the oil to be evaluated, at 150° C. for a total of 282 hours (the spent oil being replaced with fresh oil every 94 hours). On termination of this treatment the mechanical properties of the fluoroelastomer are determined, and finally a stereomicroscope of 40 × magnification is used to determine any cracks which form in the fluoroelastomer when subjected to traction up to 100% elongation.

It was found that lubricating oil formulations containing the modified disuccinimide dispersants of the present invention pass the VW PV-3344 test, its dispersant properties remaining unaltered.

The modified disuccinimides of the present invention can be used instead of or in combination with the usual commercial disuccinimides.

Hence they can be conveniently used in formulations consisting (ignoring the usual other additives of different function, such as antioxidants, anti-rust agents, anti-wear agents and possibly a non-nitrogenated viscosity index improver) essentially of the lubricant base and, as dispersant composition, the modified disuccinimide possibly in combination with non-modified disuccinimides.

In accordance therewith the present invention further provides a lubricating oil composition containing (ignoring other additives of different function) a major proportion of lubricant base possibly with a non-nitrogenated viscosity index improver, plus a dispersant composition in a quantity of between 3 and 9% by weight, said dispersant composition consisting of a modified disuccinimide of the present invention and a non-modified disuccinimide, the modified disuccinimide being between 100 and 50% by weight of the overall dispersant composition.

As is well known, polymethacrylates containing a nitrogenated monomer are used as viscosity index improvers (V.I.I.); these V.I.I.s have a certain dispersant action, however formulations containing said V.I.I.s and disuccinimide-based dispersants are incompatible with fluoroelastomers. The presence of the modified disuccinimides of the present invention, as partial or total replacement for the disuccinimides, results in formulations containing nitrogenated V.I.I.s becoming compatible with fluoroelastomers.

In accordance therewith the present invention further provides a lubricating oil composition containing (ignoring other additives of different function) a major proportion of lubricant base, a viscosity index improver of dispersant action in a quantity of between 3 and 10% by weight, and a dispersant composition in a quantity of between 3 and 9%, said dispersant composition consisting of a modified disuccinimide of the present invention and a non-modified disuccinimide, the modified disuccinimide being between 100 and 50% of the overall dispersant composition. Besides being compatible with fluoroelastomers, the modified disuccinimides of the present invention maintain dispersant properties.

As confirmation of this, the disuccinimides of the present invention pass the so-called asphaltene test. Asphaltenes are produced by oxidation of naphthenic oils in the presence of cuptic naphthenate as catalyst. The test method is as follows: 50 mg of the modified disuccinimide of the present invention are made up to 20 grams with SN150, heating slightly and agitating. A solution of 30 mg of asphaltenes in 10 ml of methylene chloride is made up separately. Said solution is then added to the solution of modified disuccinimide. The resultant solution is placed in an oven at 150° C. to eliminate volatile substances and is then left to cool. The solution is transferred into a turbidimeter cuvette and the turbidity is read off the instrument, it increasing with decreasing dispersant capacity of the disuccinimide under examination. After an initial reading the solution is centrifuged at 7500 rpm for 10 minutes and a second reading is taken from the turbidimeter. The dispersion index is given by the following equation:

$$D.I.=(\text{turbidity after centrif.}/\text{turbidity before centrif.})\times 100.$$

The absolute turbidity values also constitute a value of merit so that for equal D.I.s an additive is preferable which has given a lower absolute turbidity value.

For evaluating the modified disuccinimides of the present invention for engine use the test known as the VE sequence (ASTM STP 315 H PTIII) was carried out. For this purpose a SAE 15W50 grade lubricating oil was used containing 6.5 wt % of the modified disuccinimide under examination, 10.5 wt % of traditional additives consisting of a zinc dithiophosphate, a superbasic calcium sulphonate, a polyisobutenylsuccinimide and a sterically hindered phenol. A usual viscosity index improver based on ethylenepropylene copolymers was also used. The VE test, forming part of the official CCMC specifications, evaluates the dispersant and antioxidant performance of the lubricant and is considered to have been passed if the results of examining the engine components at the end of the test fall within the specification limits.

The following examples are given for a better understanding of the present invention.

EXAMPLES

Examples 1–3 describe the preparation of alkylated succinic anhydrides, Examples 4–7 describe the preparation of the relative disuccinimides. Examples 1–7 therefore do not form part of the present invention.

EXAMPLES 1, 2, 3

Preparation of succinic anhydrides from PIB of MW 980, 1200 and 1900.

EXAMPLE 1: preparation of polyisobutenylsuccinic anhydride from reactive polyisobutene (PIB) of molecular weight 980.

2.5 kg of reactive polyisobutene (2.5 moles) known as PIB Ultravis 10 (brand name of BP Chemicals) are placed in a reactor provided with a heating jacket, stirrer, condenser with water circulating at 70° C., thermometer, gas bubbler and funnel for adding solids. The temperature is raised to 100° C. and nitrogen blown through for one hour. 0.374 kg of maleic anhydride (3.8 moles) are reacted, corresponding to a molar ratio to the PIB of 1.5:1. The mixture is heated gradually to 200° C. and maintained at this temperature for 21 hours, recondensing into the flask the maleic anhydride which distils off. The temperature is adjusted to 180° C., the pressure inside the reactor gradually being adjusted to 10 mmHg. The excess maleic anhydride is removed by distillation, operating under these conditions for 4 hours, a stream of nitrogen then being fed onto the bottom of the reactor for one hour. A product (known as PIBSA) is obtained with an acidity, determined by the ASTM D664 method, of 52 mgKOH/g. The degree of functionalization of the polyisobutene is determined by silica gel separation chromatography, this being 754. The number of moles of succinic groups per mole of functionalized PIB is 1.26.

EXAMPLE 2: preparation of polyisobutenylsuccinic anhydride from reactive polyisobutene (PIB) of molecular weight 1200.

The procedure is conducted under the same conditions as Example 1 with 2.5 kg (2.08 moles) of reactive polyisobutene known as PIB Ultravis 30 (brand name of BP Chemicals) and 0.306 kg of maleic anhydride (3.12 moles). A product is obtained with an acidity, determined by the ASTM D664 method, of 40.7 mgKOH/g. The degree of functionalization of the PIB is 75% and the number of succinic groups per mole of functlonalized PIB is 1.28.

EXAMPLE 3: preparation of polyisobutenylsuccinic anhydride from reactive polyisobutene (PIB) of molecular weight 1900.

The procedure is conducted under the same conditions as Example 1 with 2.5 kg (1.32 moles) of reactive polyisobutene known as PIB Ultravis 70 (brand name of BP Chemicals) and 0.194 kg of maleic anhydride (1.98 moles). A product is obtained with an acidity, determined by the ASTM D664 method, of 27.9 mgKOH/g. The degree of functionalization of the PIB is 78% and the number of succinic groups per mole of functionalized PIB is 1.29.

EXAMPLES 4, 5, 6, 7

Preparation of disuccinimides from the aforegoing PIBSAs with the polyamines TETA and PEHA

EXAMPLE 4: preparation of disuccinimide from PIBSA (EX.1PIB MW 980) and triethylenetetramine (TETA).

1.25 kg of the product obtained in Example 1 (1.16 equivalents) are diluted with 1.25 kg of SN 150 mineral oil and the mixture placed in a flask fitted with a heating jacket, stirrer, condenser, thermometer and funnel for liquid addition. It is heated to 150° C., after which 0.083 kg of TETA (0.57 moles) are added through the funnel over a period of 0.5 hours. The ratio of moles of polyisobutenylsuccinic anhydride to moles of TETA is 2:1. During the addition the temperature rises spontaneously to 160° C. and the water eliminated by the reaction is distilled off. The temperature is gradually raised to 180° C., continuing to condense the water of reaction outside the reactor. The reactor is gradually put under vacuum to 10 mmHg while simultaneously feeding a nitrogen stream to the bottom of the reactor. Within one hour all the water of reaction is eliminated. 1 wt % of filter aid is added to the product, which is then filtered through a steel filter under pressure after depositing a precoat of the same aid on the filter mesh.

The product has the following characteristics: viscosity at 100° C., 80 cSt; total basic number (TBN) determined by the ASTM D2896 method, 18.2 mgKOH/g; nitrogen content, 1.34%.

EXAMPLE 5: preparation of disuccinimide from PIBSA (EX.2 MW PIB 1200) and triethylenetetramine (TETA).

The procedure is conducted under the same conditions as Example 4 using 1.25 kg of the anhydride obtained in Example 2 (0.96 equivalents), 1.25 kg of SN 150 mineral oil and 0.070 kg of TETA (0.48 moles). The product has the following characteristics: viscosity at 100° C., 114 cSt; total basic number determined by the ASTM D2896 method, 13.6 mgKOH/g; nitrogen content, 0.99%.

EXAMPLE 6: preparation of disuccinimide from PIBSA (EX.2 MW PIB 1200) and pentaethylenehexamine (PEHA).

The procedure is conducted under the same conditions as Example 4 using 1.25 kg of the anhydride obtained in Example 2 (0.96 equivalents), 1.25 kg of SN 150 mineral oil and 0.1114 kg of PEHA (0.48 moles). The product has the following characteristics: viscosity at 100° C., 130 cSt; total basic number determined by the ASTM D2896 method, 26.4 mgKOH/g; nitrogen content, 1.3%.

EXAMPLE 7: preparation of disuccinimide from PIBSA (EX.2 MW PIB 1900) and PEHA.

The procedure is conducted under the same conditions as Example 4 using 1.25 kg of the anhydride obtained in Example 3 (0.626 equivalents), 1.25 kg of SN 150 mineral oil and 0.0726 kg of PEHA (0.313 moles). The product has the following characteristics: viscosity at 100° C., 250 cSt; total basic number determined by the ASTM D2896 method, 15.5 mgKOH/g; nitrogen content, 0.88%.

Table 1 shows the various prepared disuccinimides and their main characteristics (KV is the kinematic viscosity in cSt at 100° C., TBN is the total basic number expressed in mgKOH/g, N is the % nitrogen content).

TABLE 1

| Example | PIB | Amine | KV | TBN | N |
|---|---|---|---|---|---|
| 4 | 980 | TETA | 80 | 18.2 | 1.34 |
| 5 | 1200 | TETA | 114 | 13.6 | 0.99 |
| 6 | 1200 | PEHA | 130 | 26.4 | 1.30 |
| 7 | 1900 | PEHA | 250 | 14.8 | 0.88 |

The disuccinimides of the preceding examples were evaluated by the VW PV-3344 fluoroelastomer compatibility test and by the asphaltene dispersion test, using them in a lubricant formulation containing 5 wt % of the disuccinimide under examination plus those additives commonly present in internal combustion engine lubricants to a total of 5%, namely zinc dithiophosphate of secondary alcohols, superbasic calcium sulphonate, calcium sulphophenate, and sterically hindered high molecular weight phenol deriving from 2,6-di-tertbutyl-p-cresol. The viscosity index improver used was 6 wt % of an additive consisting of a 50% solution of a methacrylic polymer of linear $C_{12}$–$C_{18}$ higher alcohols in oil. The lubricant base was SN 150 mineral base containing 30% of polyolefin having a viscosity of 6 cSt at 100° C. It is well known that to improve the dispersant performance of formulations, lubricant manufacturers use viscosity index improvement polymers with dispersant properties together with traditional polyisobutenylsuccinimide dispersants. These former polymers, of ethylene-propylene copolymer or polymethacrylic type, are obtained by introducing nitrogenated functional monomers such as vinylpyrrolidone, vinylpyridines or N,N-dimethyl amino ethylmethacrylate into the polymer chain by copolymerization or grafting. These dispersant polymers containing basic nitrogenated monomers in the chain further worsen the compatibility of the formulations with elastomers when used together with traditional dispersants of disuccinimide type.

The VW PV-3344 test and the asphaltene test were therefore also conducted on formulations analogous to those heretofore described in which the polymethacrylic viscosity index improvement polymer was replaced with the same percentage of a polymethacrylate of the same type containing in the chain about 0.8% of the nitrogenated monomer N,N-dimethyl amino methacrylate.

Table 2 shows the results of the VW PV-3344 tests for the two series of formulations containing respectively the polymethacrylate and the dispersant polymethacrylate (values in parentheses).

TABLE 2

| DISPERSANT No. | TENSILE STRENGTH | ELONGATION AT BREAK | CRACKS |
|---|---|---|---|
| VW LIMITS | >160 | >8.0 | NO |
| EX. 4 | 180 (155) | 9.3 (5.4) | YES (YES) |
| EX. 5 | 224 (166) | 10.2 (7.0) | YES (YES) |
| EX. 6 | 224 (172) | 10.4 (6.3) | YES (YES) |
| EX. 7 | 224 (180) | 10.6 (7.2) | YES (YES) |

Table 3 shows the results of the asphaltene dispersant tests for the two series of formulations containing the polymethacrylate and, in parentheses, the dispersant polyethacrylate.

TABLE 3

| DISPERSANT No. | Before Centrif. NTU | After Centrif. NTU | DISPERSION INDEX |
|---|---|---|---|
| EX. 4 | 80 (55) | 80 (55) | 100 (100) |
| EX. 5 | 60 (37) | 60 (37) | 100 (100) |
| EX. 6 | 5 (5) | 5 (5) | 100 (100) |
| EX. 7 | 6 (5) | 6 (5) | 100 (100) |

The results given in Table 2 highlight the critical behaviour of those formulations containing a disuccinimide derivative as dispersant (whether containing V.I.I. dispersants or not) towards fluoroelastomers. The results also show that those formulations containing nitrogenated polymethacrylate (data in parentheses) are much more critical than those containing non-dispersant polymethacrylate.

The asphaltene test results given in Table 3 show the excellent behaviour of the formulations with regard to their dispersant performance.

It will be demonstrated that the formulations containing the modified disuccinimides of the present invention pass the VW PV- 3344 test while maintaining their dispersant properties intact. Each of the dispersants of Examples 4, 5, 6 and 7 is treated with such a quantity of maleic anhydride as to achieve a molar ratio of maleic anhydride to disuccinimide of between 1.05 and 1.95.

EXAMPLES 8, 9, 10, 11

Modification of the disuccinimides relative to Examples 4–7.

EXAMPLE 8: treatment of the dispersant of Example 4 (PIB MW 980 with TETA) with a maleic anhydride/disuccinimide molar ratio of between 1 and 2.

1 kg of the solution of disuccinimide in oil described in Example 4 containing 500 grams of disuccinimide (0.2206 equivalents) is heated to 100° C. in a flask fitted with a diathermic oil jacket, stirrer and thermometer. 0.022 kg of maleic anhydride (0.2245 moles) are added and the temperature raised to 160° C. This temperature is maintained for two hours. The maleic anhydride/disuccinimide molar ratio is 1.02. The product has the following characteristics: TBN 11.0 mgKOH/g, viscosity at 100° C., 120 cSt. Operating in the same manner with increasing maleic anhydride/disuccinimide molar ratios, the following products were obtained:

| Dispersant | Molar ratio m.a./succ. | TBN mgKOH/g | Viscosity 100° C. (cSt) |
|---|---|---|---|
| EXAMPLE 8A | 1.02 | 11.0 | 120 |
| EXAMPLE 8B | 1.20 | 10.5 | 133 |
| EXAMPLE 8C | 1.60 | 10.3 | 130 |
| EXAMPLE 8D | 1.99 | 10.0 | 135 |

EXAMPLE 9: treatment of the dispersant of Example 5 (PIB MW 1200 with TETA) with a maleic anhydride/disuccinimide molar ratio of between 1 and 2.

1 kg of the solution of disuccinimide in oil described in Example 5, containing 500 grams or disuccinimide (0.18 equivalents) is heated to 100° C. in a flask fitted with a diathermic oil jacket, stirrer and thermometer. 0.022 kg of maleic anhydride (0.2245 moles) are added and the temperature raised to 160° C. This temperature is maintained for two hours. The maleic anhydride/disuccinimide molar ratio is 1.21. The product has the following characteristics: TBN 8.5 mgKOH/g, viscosity at 100° C., 176 cSt. Operating in the same manner with different maleic anhydride/disuccinimide molar ratios, the following products were obtained:

| Dispersant | Molar ratio m.a./succ. | TBN mgKOH/g | Viscosity 100° C. (cSt) |
|---|---|---|---|
| EXAMPLE 9A | 1.02 | 8.5 | 175 |
| EXAMPLE 9B | 1.21 | 8.5 | 176 |
| EXAMPLE 9C | 1.60 | 8.1 | 180 |
| EXAMPLE 9D | 1.99 | 7.9 | 188 |

EXAMPLE 10: treatment of the dispersant of Example 6 (PIB MW 1200 with PEHA) with a maleic anhydride/disuccinimide molar ratio of between 1 and 2.

1 kg of the solution of disuccinimide in oil described in Example 6, containing 500 grams of disuccinimide (0.18 equivalents) is heated to 100° C. in a flask fitted with a diathermic oil jacket, stirrer and thermometer. 0.022 kg of maleic anhydride (0.2245 moles) are added and the temperature raised to 160° C. This temperature is maintained for two hours. The maleic anhydride/disuccinimide molar ratio is 1.25. The product has the following characteristics: TBN 8.5 mgKOH/g, viscosity at 100° C., 249 cSt. Operating in the same manner with different maleic anhydride/disuccinimide molar ratios, the following products were obtained:

| Dispersant | Molar ratio m.a./succ. | TBN mgKOH/g | Viscosity 100° C. (cSt) |
|---|---|---|---|
| EXAMPLE 10A | 1.02 | 15.5 | 247 |
| EXAMPLE 10B | 1.25 | 15.5 | 249 |
| EXAMPLE 10C | 1.60 | 14.9 | 253 |
| EXAMPLE 10D | 1.99 | 14.0 | 255 |

EXAMPLE 11: treatment of the dispersant of Example 7 (PIB MW 1900 with PEHA) with a maleic anhydride/disuccinimide molar ratio of between 1 and 2.

1 kg of the solution of disuccinimide in oil described in Example 7, containing 500 grams of disuccinimide (0.1193 equivalents) is heated to 100° C. in a flask fitted with a diathermic oil jacket, stirrer and thermometer. 0.022 kg of maleic anhydride (0.2245 moles) are added and the temperature raised to 160° C. This temperature is maintained for two hours. The maleic anhydride/disuccinimide molar ratio is 1.88. The product has the following characteristics: TBN 8.3 mgKOH/g, viscosity at 100° C., 270 cSt. Operating in the same manner with increasing maleic anhydride/disuccinimide molar ratios, the following products were obtained:

| Dispersant | Molar ratio m.a./succ. | TBN mgKOH/g | Viscosity 100° C. (cSt) |
|---|---|---|---|
| EXAMPLE 11A | 1.02 | 9.0 | 265 |
| EXAMPLE 11B | 1.20 | 8.8 | 266 |
| EXAMPLE 11C | 1.60 | 8.7 | 265 |
| EXAMPLE 11D | 1.88 | 8.3 | 270 |

The maleic anhydride-treated dispersants of Examples 8, 9, 10 and 11 were evaluated by the VW PV-3344 fluoroelastomer compatibility test and the asphaltene test. They were used in a 5 wt % concentration in the previously described lubricant formulation together with 6% of dispersant polymethacrylate as viscosity index improver, this making it more difficult to pass the fluorinated elastomer compatibility test.

Table 4 also shows data in parentheses relating to formulations analogous to the preceding, but containing a non-dispersant polymethacrylate.

TABLE 4

| Disp. No. | Tens. Strength | Elong. break | Cracks | Before centr. NTU | After centr. NTU | Disp. index |
|---|---|---|---|---|---|---|
| 8A | 159 | 6.3 | Yes | 60 | 60 | 100 |
| 8B | 185 | 8.2 | No | 73 | 73 | 100 |
| 8C | 200 (230) | 9.3 (9.4) | No (No) | 88 (93) | 88 (93) | 100 (100) |
| 8D | 225 | 9.4 | No | 110 | 100 | 91 |
| 9A | 199 | 7.9 | Yes | 99 | 99 | 100 |
| 9B | 216 (239) | 9.2 (9.3) | No (No) | 120 (130) | 120 (130) | 100 (130) |
| 9C | 220 | 9.3 | No | 135 | 135 | 100 |
| 9D | 227 | 8.4 | No | 210 | 189 | 90 |
| 10A | 180 | 8.3 | Yes | 115 | 115 | 100 |
| 10B | 200 (225) | 9.4 (9.4) | No (No) | 119 (123) | 119 (123) | 100 (100) |
| 10C | 237 | 9.3 | No | 211 | 211 | 100 |
| 10D | 235 | 9.4 | No | 320 | 210 | 66 |
| 11A | 218 | 8.8 | Yes | 123 | 123 | 100 |
| 11B | 216 | 9.1 | No | 154 | 154 | 100 |
| 11C | 238 (240) | 9.2 (9.4) | No (No) | 288 (290) | 288 (290) | 100 (100) |
| 11D | 247 | 9.2 | No | 356 | 215 | 60 |

From the results shown in Table 4 it is apparent that treating the dispersant with a maleic anhydride/disuccinimide molar ratio which is only slightly greater than 1 (cases A of the examples) is insufficient to render the formulation compatible with elastomers. Moreover, if a maleic anhydride/disuccinimide molar ratio of slightly less than 2 is used (cases D of the examples), the formulations behave very well towards fluoroelastomers, but to the detriment of dispersion (dispersion index considerably less than 100). Those treatments using a maleic anhydride/disuccinimide molar ratio of between 1.2 and 1.6 simultaneously achieve elastomer compatibility and a lubricant dispersion index of 100.

EXAMPLE 12

A formulation is prepared containing 5 wt % of the dispersant of Example 11B, 6% of dispersant polymethacrylate and 5% of anti-wear, detergent and anti-oxidant additives. A semisynthetic base is used consisting of 30% polyolefin and 70% of SN 150.

The lubricating oil formulated in this manner is subjected to the VE sequence. The results are given in Table 5 together with the specified limits, these latter in parentheses.

TABLE 5

| | |
|---|---|
| Engine sludge | 9.2 (minimum 9) |
| Piston skirt varnish | 7.2 (minimum 6.5) |
| Average varnish | 5.9 (minimum 5) |
| Average cam wear | 5μ (maximum 5) |
| Maximum cam wear | 11μ (maximum 15) |

We claim:

1. An oil-soluble additive with dispersant properties inert towards fluoroelastomers, prepared by reacting:

a) at least one alkyl or alkenyl disuccinimide having at least one basic nitrogen, with b) at least one anhydride of an unsaturated bicarboxylic aliphatic acid or the corresponding acid, at a temperature of between 130° and 170° C., the molar ratio of anhydride to disuccinimide being between 1.2 and 1.6.

2. An additive as claimed in claim 1, characterized in that the anhydride (b) has the following general formula:

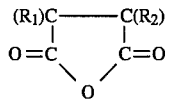

where $R_1$ and $R_2$ are independently chosen from H and a $C_1$–$C_4$ alkyl or alkenyl radical, and wherein $(R_1)C$–$C(R_2)$ is $(R_1)C{=}C(R_2)$ or $(R_1)_2C$–$C{=}(R_2)$.

3. An additive as claimed in claim 1, wherein the anhydride (b) is maleic anhydride.

4. An additive as claimed in claim 1, wherein the reaction between the disuccinimide and the anhydride (b) takes place at a temperature of between 140° and 160° C.

5. An additive as claimed in claim 1, wherein the reaction is conducted in the presence of an inert solvent.

6. An additive as claimed in claim 5, wherein the solvent is a mineral base.

7. A lubricating oil composition containing a major proportion of lubricant base alone or with a non-nitrogenated viscosity index improver, and a dispersant composition in a quantity of between 3 and 9% by weight, said dispersant composition consisting of (1) the additive of claim 1 and (2) at least one alkyl or alkenyl disuccinimide having at least one basic nitrogen, the additive of claim 1 being between 100 and 50% by weight of the overall dispersant composition.

8. A lubricating oil composition containing a major proportion of lubricant base, a viscosity index improver of dispersant action in a quantity of between 3 and 10% by weight, and a dispersant composition in a quantity of between 3 and 9%, said dispersant composition consisting of (1) the additive of claim 1 and (2) at least one alkyl or alkenyl disuccinimide having at least one basic nitrogen, the additive of claim 1 being between 100 and 50% of the overall dispersant composition.

* * * * *